US008529734B2

(12) United States Patent
Kochanski et al.

(10) Patent No.: US 8,529,734 B2
(45) Date of Patent: Sep. 10, 2013

(54) WALL PROTECTOR FOR A HEATING WALL HEAD BETWEEN TWO OVEN CHAMBER OPENINGS OF A COKE OVEN BATTERY

(75) Inventors: Ulrich Kochanski, Gummersbach (DE); Helmut Dohle, Bochum (DE); Manfred Friedrichs, Essen (DE)

(73) Assignee: UHDE GmbH, Dortmund (DE)

( * ) Notice: Subject to any disclaimer, the term of this patent is extended or adjusted under 35 U.S.C. 154(b) by 460 days.

(21) Appl. No.: 12/988,335

(22) PCT Filed: May 13, 2009

(86) PCT No.: PCT/EP2009/003399

§ 371 (c)(1), (2), (4) Date: Nov. 18, 2010

(87) PCT Pub. No.: WO2009/141086

PCT Pub. Date: Nov. 26, 2009

(65) Prior Publication Data

US 2011/0048919 A1 Mar. 3, 2011

(30) Foreign Application Priority Data

May 21, 2008 (DE) ..... 10 2008 024 573

(51) Int. Cl.
*C10B 29/08* (2006.01)

(52) U.S. Cl.
USPC ..... 202/223; 202/267.1

(58) Field of Classification Search
USPC ..... 202/222, 223, 248, 267.1, 268, 269; 432/250, 252
See application file for complete search history.

(56) References Cited

U.S. PATENT DOCUMENTS 1,757,988 A 5/1930 Wilhelm
4,749,446 A * 6/1988 van Laar et al. ..... 202/139

FOREIGN PATENT DOCUMENTS

DE 3741301 B 12/1988

OTHER PUBLICATIONS

Toll, "Modernisation Techniques to Control Pollution From Coke Oven Batteries", Steel Times, Fuel & Metallurgical Journels Ltd., London, GB, vol. 218, No. 3, Mar. 1, 1990.*

* cited by examiner

*Primary Examiner* — Jill Warden
*Assistant Examiner* — Joye L Woodard
(74) *Attorney, Agent, or Firm* — Andrew Wilford

(57) ABSTRACT

A coke-oven battery has at least two chambers separated by a heating wall head and having openings provided with vertical jambs juxtaposed with the head. An upright anchor post is spaced horizontally forward from the head, and a plurality of U-shaped yokes are provided between the post and the head. Biasers bear on the anchor post and press the yokes against the jambs and thereby press the jambs against the head. A thin-walled sheet-metal head cover having upright edges is clamped between the jambs and the head and extends horizontally as a single piece between the jambs.

7 Claims, 1 Drawing Sheet

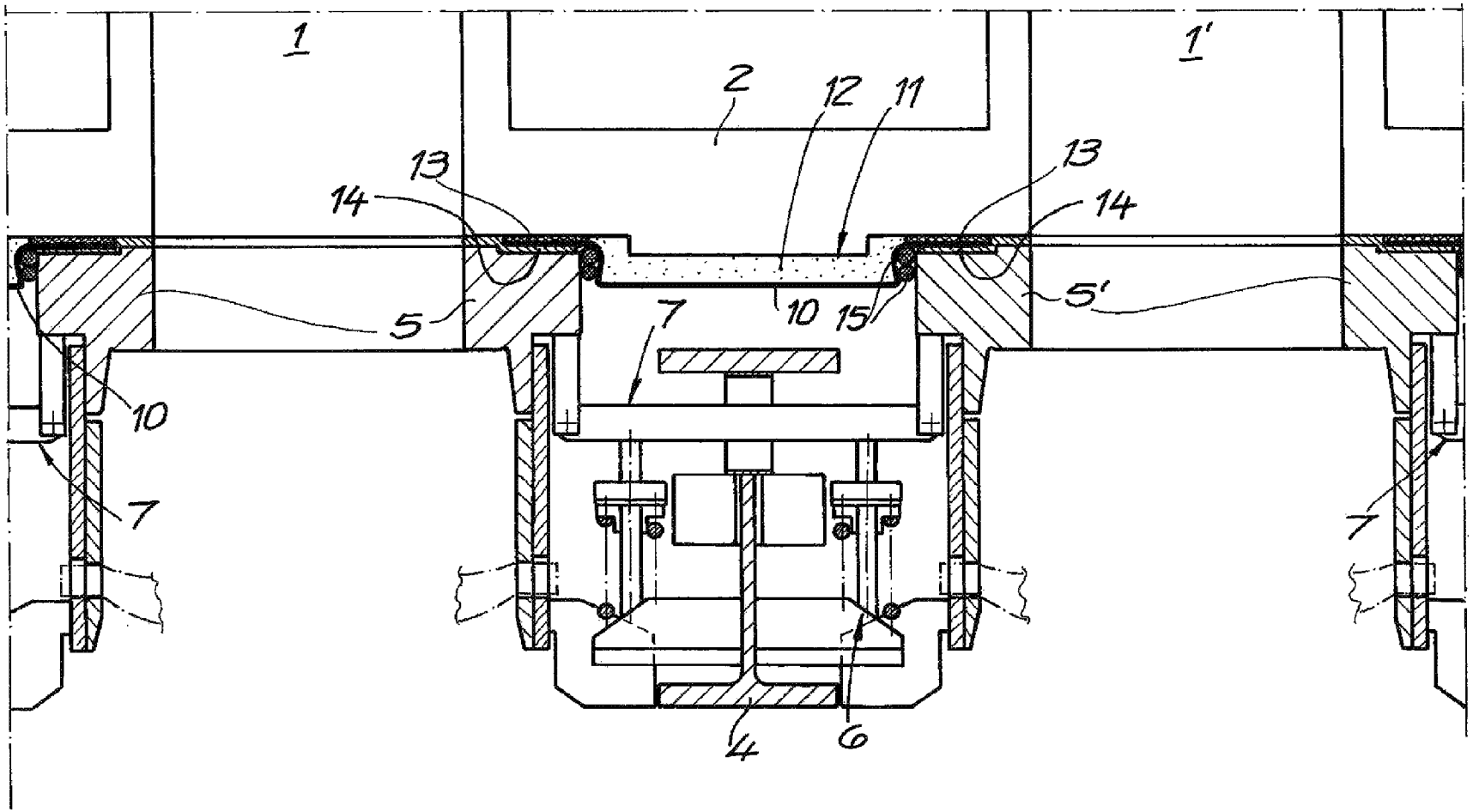
1'
1
2
11
12
13
14
5'
5
15
10
7
6
4

WALL PROTECTOR FOR A HEATING WALL HEAD BETWEEN TWO OVEN CHAMBER OPENINGS OF A COKE OVEN BATTERY

CROSS REFERENCE TO RELATED APPLICATIONS

This application is the US national stage of PCT application PCT/EP2009/003399, filed 13 May 2009, published 26 Nov. 2009 as 2009/141086, and claiming the priority of German patent application 102008024573.9 itself filed 21 May 2008.

FIELD OF THE INVENTION

The invention relates to a wall protector for a heating oven head between two chamber openings of a coke-oven battery that is laterally bounded by vertical jambs extending along the chamber openings. The insulating device comprises a vertical anchor post located in front of the heating oven head, as well as biasers that are fixed to the anchor post. Moreover, the insulating device is provided with U-shaped yoke elements that are prestressed by the biasers, as well as a rectangular head cover.

BACKGROUND OF THE INVENTION

From DE 37 41 301, a wall-protection plate for coking ovens is known. Coking ovens of the type described there are collectively referred to as coke-oven batteries, so that the chamber openings are always opened to one side. The masonry between these chamber openings that are provided with heavy coke-oven doors in a sequence of chambers is termed the heating wall head and consists primarily of silica insulating mixture, firebrick or sillimanite. The chamber openings are each surrounded by an chamber frame that receives the respective coke-oven door and that extends over part of the heating wall head on one side with its vertically extending profiled jamb. The still open heating wall section between the vertical profiles of the chamber frames of adjacent chamber openings is covered by the wall-protection plate. Based on the thermal load to which the masonry of the heating walls is exposed at temperatures of over 1,000° C., robust anchoring is required to hold the masonry together. The vertical jambs that delimit the heating wall head laterally are therefore supported at several points against an anchor post fixed in front of the heating wall head, this the anchor post being fixed at its upper and lower ends.

At the same time, there is a need for a gas-tight gasket seal of the heating wall head to avoid emissions. Previously this sealing was accomplished by inserting insulating mats between the jambs and the heating wall head, as well as by caulking a mortise groove formed between the jambs, the oven head masonry and the wall protection plate.

Beyond that, these wall protection plates have the function of transmitting the required anchoring forces, as a result of which the plates became very thick and thus also became heavy and unwieldy. The thick plates react sensitively to temperature differences, which leads to thermal bending of the plates that acts counter to the anchoring forces. The desired application of force onto the heating wall head masonry is thereby changed disadvantageously.

OBJECT OF THE INVENTION

Given this background, the object of invention is to provide a wall protector for a heating wall head that satisfies the functions described above, and that does not require a massive wall protection plate.

SUMMARY OF THE INVENTION

Based on a wall protector with the characteristics described above, the object is attained in accordance with the invention in that the prestressed U-shaped yoke elements abut in a force-fit at bearing faces of the vertical jambs, and that the head cover consists of thin-walled sheet metal that is clamped between the jambs and the heating wall head. The vertical jambs that delimit the heating wall head and extend along the chamber openings are prestressed directly by the yoke elements with the necessary anchoring force, without a detour over the massive plate. The sealing is accomplished by means of the sheet metal retained in a force-fit between the heating wall head and the chamber frame. The wall protection in accordance with the invention offers the advantage that the sheet metal adapts to the shape of the wall and the frame, as a result of which a sealing effect is achieved. The flexible, thin-walled design of the head cover as sheet metal offers, beyond that the advantage that thermal bending is significantly lowered with respect to more massive material, as a result of which an improved adaptation to the shape of the heating wall head masonry is given. In addition, gasket elements can be provided between the heating wall head and the sheet metal and/or between the sheet metal and the vertical chamber jambs. An advantageous embodiment provides that the edges of the sheet metal that are clamped between the jambs and the heating wall head that form the head cover are embedded on both sides between layers consisting of a sealing material.

The sheet metal forming the head cover is preferably shaped as a hood, so that a cavity is formed between the sheet metal and the heating wall head that can be filled with an insulating material, for example, mats of aluminum silicate. Advantageously, the hood has a horizontal cross section profile that is Z-shaped at the longer sides and is essentially shaped of right angles, so that a cavity forms between the hood and the heating wall head. This cavity has an essentially rectangular horizontal cross-sectional shape. In a gap between the hood and the faces of the jambs, seals can be arranged in the form of cords or packing gasket so that this gap has an essentially rectangular horizontal cross section profile.

The device in accordance with the invention is particularly suitable for sealing heating wall heads that consist of silicon, fire clay or sillimanite rocks.

BRIEF DESCRIPTION OF THE DRAWING

In the following, the invention is explained in conjunction with a drawing illustrating only one embodiment. The sole FIGURE is a schematic horizontal cross section through a portion of a heating wall head of a coke-oven battery with two adjacent coking chambers that are located right and left of a heating wall head.

DETAILED DESCRIPTION

The FIGURE shows the openings 1 and 1' of two adjacent coking chambers and a heating wall head 2 located between them. The coking chambers are circumferentially bordered by chamber frames. The vertical jambs 5 and 5' of the chamber frames define the sides of the oven chamber. A vertical post 4 that is anchored at its upper and lower ends carries spring-type biasers 6 in front of the heating wall head 2. The biasers 6 press U-shaped yoke elements 7 against front faces of the jambs 5 and 5' so as to retain the jambs 5 and 5' against the heating wall head 2. A thin piece of sheet metal 10 forming a head cover completely covering the heating-wall head 2 lies between the masonry of the heating wall head 2 and the jambs 5 and 5'. In the region between the jambs 5 and 5' and the heating wall head 2, the edges of the sheet-metal cover are embedded between layers 13 and 14 of a sealing material.

The FIGURE shows that the sheet metal forming the head cover 10 is shaped as a hood where the edges of the head cover lie in a common plane flatly against the head outer face and a planar central part of the head cover is spaced outward from the common plane and connected to the edges by unitary webs extending generally perpendicular to the common plane, so that a cavity 11 is formed between the sheet metal and a generally flat outer face of the heating wall head 2. In horizontal cross section, the hood has a horizontal cross section profile that can be described as Z-shaped at the longer sides, formed at essentially right angles, so that the cavity 11 formed between the hood and the head wall is essentially of rectangular cross section. The cavity 11 is filled with an insulating material 12 that consists of, for example mats of aluminum silicate. A gap formed between the hood and the faces of the jambs 5 and 5' and formed by the shape of the hood and the jambs 5 and 5' has an essentially rectangular horizontal cross section profile, and for better sealing further seals 15 are provided in the form of cords or a packing gasket.

The invention claimed is:

1. In combination with a coke-oven battery having at least two chambers separated by a heating wall head and having openings provided with vertical jambs juxtaposed with the head, an upright anchor post spaced horizontally forward from the head;

a plurality of U-shaped yokes between the post and the head;

biasing means bearing on the anchor post and pressing the yokes against the jambs and thereby pressing the jambs against the head; and a thin-walled sheet-metal head cover having upright edges clamped between the jambs and the head and extending horizontally as a single piece between the jambs.

2. The combination defined in claim 1, further comprising sealing material between the edges of the sheet-metal head cover and the jambs or head.

3. The combination defined in claim 2 wherein the sealing material is between the edges and the head.

4. The combination defined in claim 1 wherein the head has an outer face that is generally flat and the head cover is nonplanar and forms with the head outer face a cavity.

5. The combination defined in claim 4 wherein the edges of the head cover lie in a common plane flatly against the head outer face and the head cover has a planar central part spaced outward from the plane and connected to the edges by unitary webs generally perpendicular to the plane.

6. The combination defined in claim 4, further comprising a mass of thermal insulation generally filling the cavity.

7. The combination defined in claim 6 wherein the mass is comprised of mats of aluminum silicate.

* * * * *